US007568342B2

(12) United States Patent
Cloppenburg et al.

(10) Patent No.: US 7,568,342 B2
(45) Date of Patent: Aug. 4, 2009

(54) SUPPLY PUMP ACTUATING TURBINE

(75) Inventors: Reinhard Johannes Severin Cloppenburg, Hirschberg-Leutershausen (DE); Dirk Hartmann, Muehlhausen (DE); Stefan Klatt, Mannheim (DE); Karsten Mueller, Viernheim (DE)

(73) Assignee: Alstom Technology Ltd, Baden (CH)

( * ) Notice: Subject to any disclaimer, the term of this patent is extended or adjusted under 35 U.S.C. 154(b) by 557 days.

(21) Appl. No.: 11/369,580

(22) Filed: Mar. 7, 2006

(65) Prior Publication Data

US 2006/0207256 A1 Sep. 21, 2006

(30) Foreign Application Priority Data

Mar. 8, 2005 (CH) ..... 0406/05

(51) Int. Cl.
*F01K 7/34* (2006.01)

(52) U.S. Cl. ..... 60/653; 60/677; 60/679

(58) Field of Classification Search ..... 60/653, 60/677–680

See application file for complete search history.

(56) References Cited

U.S. PATENT DOCUMENTS

| | | | | |
|---|---|---|---|---|
| 2,268,356 | A * | 12/1941 | Turner | 60/653 |
| 2,921,770 | A | 1/1960 | Frankel | 253/77 |
| 3,322,153 | A * | 5/1967 | Rankin | 137/630.19 |
| 3,686,867 | A * | 8/1972 | Hull | 60/667 |
| 3,973,402 | A * | 8/1976 | Silvestri, Jr. | 60/678 |
| 4,373,340 | A * | 2/1983 | Keller | 60/677 |
| 4,576,008 | A * | 3/1986 | Silvestri, Jr. | 60/662 |

FOREIGN PATENT DOCUMENTS

| | | |
|---|---|---|
| DE | 967 498 | 11/1957 |
| DE | 1401459 | 10/1968 |
| DE | 4023900 A1 | 1/1992 |
| EP | 0520258 | 12/1992 |
| FR | 1.314.454 | 1/1963 |
| FR | 1.332.663 | 7/1963 |
| FR | 1.352.902 | 2/1964 |

OTHER PUBLICATIONS

International Search Report for CH 00406/05 (3 pages) and brief translation thereof (1 page).
German Search Report for DE 10 2005 048 883.8 (4 pages) and brief translation thereof (1 page).
German Search Report for DE10 2006 009 558.8 dated Jun. 19, 2006.

* cited by examiner

*Primary Examiner*—Hoang M Nguyen
(74) *Attorney, Agent, or Firm*—Darby & Darby

(57) ABSTRACT

A supply pump actuating turbine, in particular for a power plant, that includes at least two jet sectors for introducing a working gas into the turbine, a line system for connecting the at least two jet sectors to at least two different sources of working gas, and a valve arrangement for setting the supply of the jet sectors with the working gas from at least one of the sources. The valve arrangement and the line system are designed in such a way that at least three operating states can be set: a first operating state, in which all the jet sectors are supplied with the working gas of the first source, a second operating state, in which all the jet sectors are supplied with the working gas of the second source, and a third operating state, in which at least one of the jet sectors is supplied with the working gas of the first source and at least one other of the jet sectors is supplied with the working gas of the second source.

14 Claims, 2 Drawing Sheets

SUPPLY PUMP ACTUATING TURBINE

Priority is claimed to Swiss Application No. 00406/05, filed on Mar. 8, 2005, the entire disclosure of which is incorporated by reference herein.

The present invention relates to a supply pump actuating turbine (SPAT), in particular for a power plant.

BACKGROUND

A supply pump actuating turbine, or SPAT, serves, in a power plant, for driving a supply pump which supplies feed water to a steam generator. A steam generator of this type is required, above all, in a steam turbine which operates with the steam of the steam generator.

Conventionally, a SPAT of this type comprises at least two jet sectors, with the aid of which a working gas can be introduced into the turbine, that is to say, to the SPAT. The working gas is expediently steam which is in any case available in a steam turbine in conjunction with a steam generator. Furthermore, the SPAT comprises a line system, with the aid of which the at least two jet sectors can be connected to at least two different sources of working gas. When the power plant is operating normally, the SPAT is supplied with bleed steam which is bled off at a suitable point on a steam turbine, preferably on a medium-pressure turbine. The bleeding point of the steam turbine at which the bleed steam is bled off forms in this case one source of working gas.

In specific operating states of the power plant, no bleed steam is available. So that the SPAT can nevertheless be operated, it is possible to use cold resuperheated steam for this purpose. In a steam turbine group which consists at least of a high-pressure turbine and of a medium-pressure turbine, the steam expanded in the high-pressure turbine is superheated in a steam generator or in a steam heater before it is supplied to the medium-pressure turbine. This superheating between the two turbines is designated as resuperheating. The cold resuperheated steam in this case corresponds to the expanded steam which comes from the high-pressure turbine and which is not yet superheated. A steam line which transports the steam from the high-pressure turbine to the steam heater forms in this case a further source of working gas.

Furthermore, the SPAT may be equipped with a valve arrangement which makes it possible to set the supply of the jet sectors with the working gas from at least one of the two sources, particularly in terms of the quantity of working gas supplied.

Under specific preconditions, it may be necessary to maintain a special operating state deviating from normal operation even for a relatively long period of time. It is consequently desirable that the SPAT has as high efficiency as possible both in normal operation with bleed steam and in special operation with cold resuperheated steam.

SUMMARY OF THE INVENTION

An object of the present invention is to specify for a supply pump actuating turbine an improved embodiment which has comparatively high efficiency, in particular, with working gas from various sources.

The present invention provides a supply pump actuating turbine that includes:

at least two jet sectors configured to introduce a working gas into the turbine;

a first source of working gas;

a second source of working gas;

a line system connecting the at least two jet sectors to the first and second sources;

a valve arrangement configured to adjust a supply of the working gas to the jet sectors from at least one of the first and second sources according to one of at least three operating states, including:

a first operating state; wherein the at least two jet sectors are supplied with the working gas from the first source;

a second operating state, wherein the at least two jet sectors are supplied with the working gas from the second source; and a third operating state, wherein at least one of the jet sectors is supplied with the working gas from the first source and at least one other of the jet sectors is supplied with the working gas of the second source.

The invention is based on the general idea of designing the valve arrangement and the line system in such a way that at least three operating states can consequently be implemented. In a first operating state, all the jet sectors are supplied solely or essentially solely with the working gas of the first source. This results in optimum action of the working gas of the first source upon the blading of the turbine along all the jet sectors, as a consequence of which a high efficiency is achieved for this first operating state. Furthermore, a second operating state can be implemented, in which all the jet sectors are supplied solely or essentially solely with the working gas of the second source. In this operating state, too, there is uniform action upon the blading of the turbine along all the jet sectors, thus likewise leading to relatively high efficiency for the second operating state. Moreover, a third operating state can also be implemented, which is characterized in that, on the one hand, at least one of the jet sectors is supplied solely or essentially solely with the working gas of the first source, while, on the other hand, at least one other of the jet sectors is supplied solely or essentially solely with the working gas of the second source. Dual operation, that is to say simultaneous operation with the working gases of both sources, thereby becomes possible, in which action upon the blading of the turbine can likewise be carried out along all the jet sectors. Thus, in the third operating state too, a relatively high efficiency can be achieved.

The SPAT according to the invention is thus distinguished by particularly high flexibility in terms of the working gas supplied and can achieve a comparatively high efficiency in all three operating states mentioned.

According to a preferred embodiment, the three operating states mentioned can be implemented in that the line system has a first source line connected to the first source and a second source line connected to the second source, a connecting line being provided, moreover, which connects the first source line to the second source line. Furthermore, the valve arrangement comprises a valve which is arranged in the connecting line and with the aid of which the connecting line can be opened and shut off. Furthermore, the line system comprises, for each jet sector, a sector line which is connected to one of the source lines. With the first source activated and the second source deactivated, the working gas of the first source can be supplied to all the jet sectors by the connecting line being opened. By the first source being deactivated and the second source being activated, the working gas of the second source can be supplied to all the jet sectors, with the connecting line open. With the connecting line shut off, the working gas of the first source can be supplied to all the jet sectors, the sector line of which is connected to the first source line, while at the same time the working gas of the second source can be supplied to all the jet sectors, the sector line of which is connected to the second source line. The outlay in terms of implementing a line system of this type and a valve arrangement of this type is in this case comparatively low. If in particular, a conventional line system and a conventional valve arrangement may in large parts be adopted, unchanged. Correspondingly, in a conventional SPAT, the invention can be implemented even by means of comparatively cost-effective conversion measures, specifically even at a later date.

Further important features and advantages of the SPAT according to the invention may be gathered from the claims, from the drawings and from the associated figure description with reference to the drawings.

BRIEF DESCRIPTION OF THE DRAWINGS

Preferred exemplary embodiments of the invention are illustrated in the drawings and are explained in more detail in the following description, the same reference symbols referring to identical or similar or functionally identical components. In the drawings, in each case diagrammatically.

DETAILED DESCRIPTION

Figure 1:
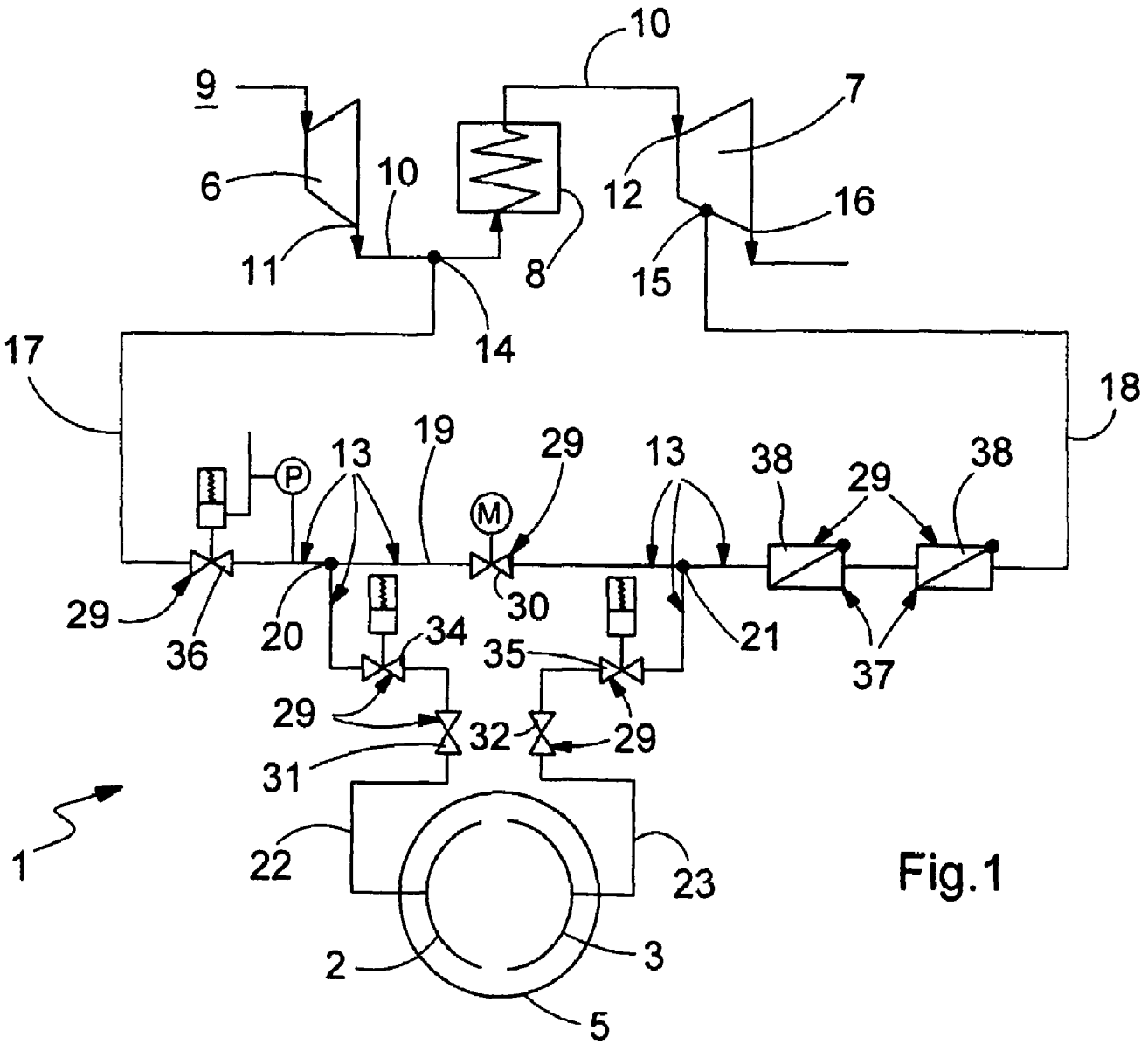
FIG. 1 shows a greatly simplified basic illustration of a supply pump actuating turbine according to the invention in a manner of a circuit diagram.

According to FIGS. 1 and 2, a supply pump actuating turbine 1, which is also designated below in brief by SPAT 1 or only by turbine 1, comprises at least two jet sectors, to be precise a first jet sector 2 and a second jet sector 3. The embodiment according to FIG. 1 has only these two jet sectors 2, 3. In contrast to this, in the embodiment according to FIG. 2, a third jet sector 4 is provided. It is clear that, in another embodiment, even more than three jet sectors may be provided.

The jet sectors 2, 3, 4 serve for introducing a working gas into the turbine 1. For this purpose, the jet sectors 2, 3, 4 are arranged in a housing 5 of the turbine 1, specifically upstream of a blading, not shown, of the turbine 1. The jet sectors 2, 3, 4 extend, correspondingly to the blading, along segments of an arc of a circle. The jet sectors 2, 3, 4 have, in the usual way, outlet ports or outlet jets, through which the respective working gas arrives at the blading of the turbine 1. In order to achieve as high an efficiency as possible for the turbine 1, it is advantageous if the jet sectors 2, 3, 4 in the respective turbine 1 add up essentially to a closed ring. In this way, when the blading is acted upon by all the jet sectors 2, 3, 4, a homogeneous supply of the working gas along the entire circumference of the blading can be achieved.

The SPAT 1 is conventionally a component of a power plant for current generation which is equipped at least with a steam turbine. In the preferred variant shown here, the power plant comprises at least one high-pressure steam turbine or a high-pressure turbine 6 and at least one medium-pressure steam turbine or medium-pressure turbine 7. It is clear that at least one low-pressure steam turbine or low-pressure turbine may also be provided. Furthermore, the power plant is equipped with a steam heater 8.

When the power plant is in operation, the high-pressure turbine 6 receives steam which is under high pressure from a steam generator 9. The steam expanded in the high-pressure turbine 6 is supplied via a steam line 10 to the medium-pressure turbine 7 via the steam heater 8. For this purpose, the steam line 10 connects an outlet 11 of the high-pressure turbine 6 to an inlet 12 of the medium-pressure turbine 7, the steam line 10 being led through the steam heater 8. The steam heater 8 operates, here, as a resuperheating stage and allows a resuperheating of the steam coming from the high-pressure turbine 6 before it is introduced into the medium-pressure turbine 7. The steam transported in the steam line 10 is correspondingly resuperheated steam, specifically "cold" resuperheated steam upstream of the steam heater 8 and "hot" resuperheated steam downstream of the steam heater 8. In this case, the steam heater 8 may form a component of the steam generator 9 and, in particular, be integrated into the latter.

The SPAT 1 serves for driving a supply pump, not shown here, which, in turn, supplies the steam generator 9 with feed water.

The SPAT 1 comprises, moreover, a line system 13, with the aid of which the jet sectors 2, 3, 4 are connected to at least two different sources of working gas. In the embodiments shown here, only two such sources are provided; in principle, even more than two sources of working steam may be provided. The first source is in this case formed by the steam line 10, to which the line system 13 is connected at a connection point 14. The first source is therefore also designated below by the reference symbol 10. The second source is formed, in the present case, by a bleeding point 15, via which the line system 13 is connected to the medium-pressure turbine 7. Said bleeding point 15 is in this case arranged on a suitable turbine stage of the medium-pressure turbine 7, expediently between the inlet 12 and an outlet 16 of the medium-pressure turbine 7.

In the embodiments shown here, the line system 13 comprises a first source line 17, which is connected to the first source 10, and a second source line 18, which is connected to the second source 15. Furthermore, the line system 13 comprises a connecting line 19 which is connected to the first source line 17 via a first connection point 20 and to the second source line 18 via a second connection point 21. The connecting line 19 thereby connects the two source lines 17, 18.

Furthermore, the line system 13 comprises a sector line for each jet sector 2, 3, 4. In the present case, therefore, the line system 13 comprises a first sector line 22 connected to the first jet sector 2 and a second sector line 23 connected to the second jet sector 3. Additionally, in the embodiment according to FIG. 2, a third sector line 24 is provided, which is connected to the third jet sector 4. Each sector line 22, 23, 24 is connected to one of the source lines 17, 18. In the examples shown here, the first sector line 22 is connected to the first source line 17, specifically via the first connection point 20. In contrast to this, the second sector line 23 is connected to the second source line 18, specifically via the second connection point 21. Moreover, in the embodiment according to FIG. 2, the third sector line 24 is likewise connected to the second source line 18, specifically likewise via the second connection point 21.

Figure 2:
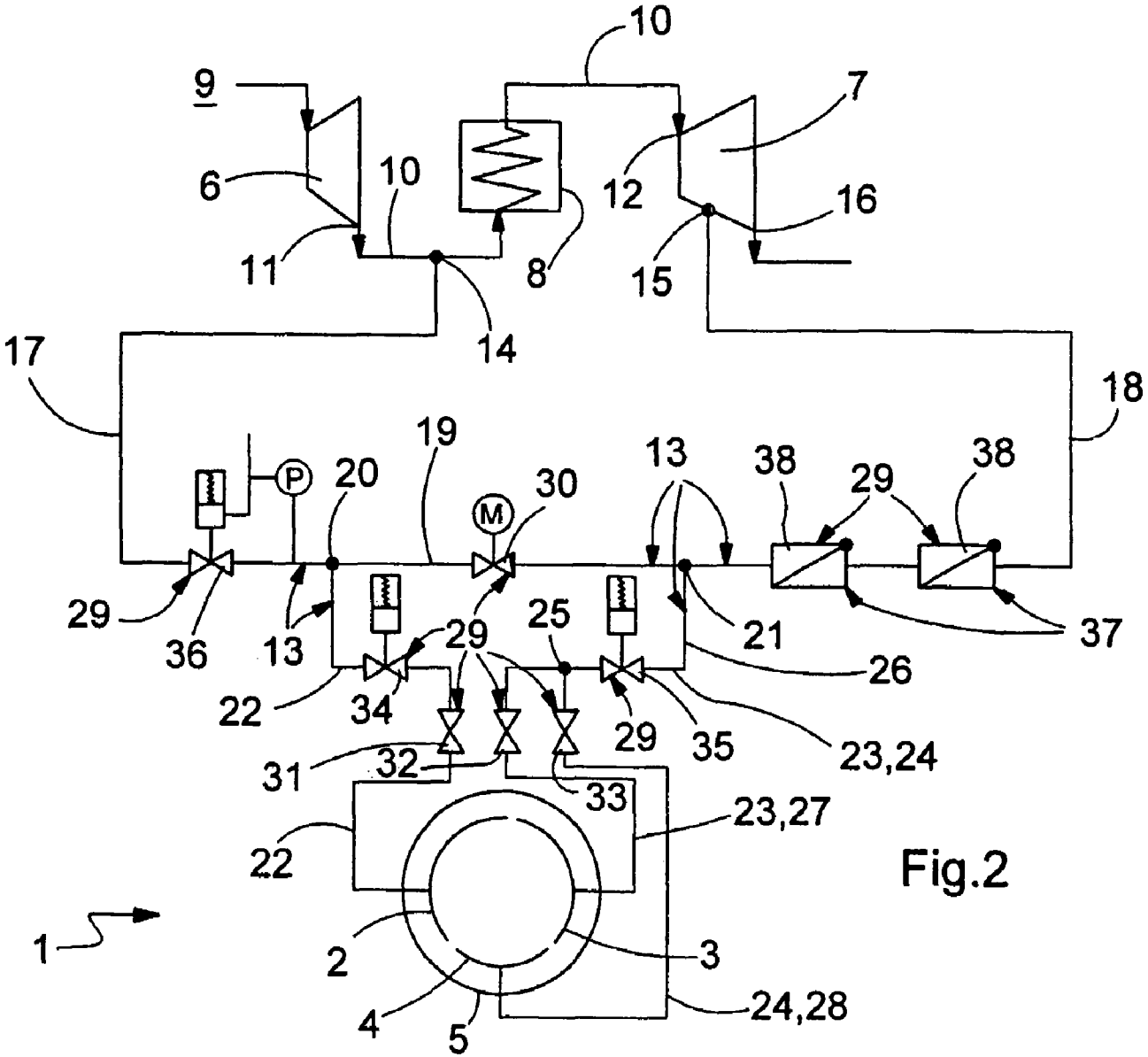
FIG. 2 shows an illustration, as in FIG. 1, but in another embodiment.

Furthermore, in the embodiment according to FIG. 2, the two sector lines 23, 24 connected to the second source line 18 are led separately as far as a connecting point 25 and are led away from the latter together. These two sector lines 23, 24 are equipped correspondingly with a common source portion 26 which is connected to the second source line 18 via the second connection point 21 and which leads to the connecting point 25. Moreover, these two sector lines 23, 24 are assigned in each case a sector portion, to be precise a first sector portion 27, which connects the second jet sector 3 to the source portion 26 via the connecting point 25, and a second sector portion 28, which connects the third jet sector 4 to the source portion 26 via the connecting point 25.

Finally, the SPAT 1 possesses a valve arrangement 29, with the aid of which the supply of the jet sectors 2, 3, 4 with the working gas of the sources 10, 15 can be set. In the embodiments shown here, the valve arrangement 29 comprises a coupling valve 30 which is arranged in the connecting line 19 and with the aid of which the valve line 19 can be opened and shut off. Preferably, this coupling valve 30 is designed as a motor valve, and in this case the coupling valve 30 may have, in addition to an open position and a shut position, at least one further intermediate position which can be set in order to set a quantity of the working gas which flows through the connecting line 19.

The valve arrangement 29 expediently comprises a quick-action closing valve in each sector line 22, 23, 24. The first sector line 22 correspondingly contains a first quick-action closing valve 31, while-the second sector line 23 contains a second quick-action closing valve 32. In the embodiment according to FIG. 2, moreover, a third quick-action closing valve 33 is arranged in the third sector line 24. Each quick-action closing valve 31, 32, 33 serves to make it possible, as required, to shut off the respective sector line 22, 23, 24 comparatively quickly.

Furthermore, the valve arrangement 29 comprises a setting valve for each sector line 23, 24, 25. In the embodiments shown here, the first sector line 22 contains a first setting valve 34, while the second sector line 23 contains a second setting valve 35. In the embodiment according to FIG. 2, the second setting valve 35 is arranged in the common source portion 26 of the second and the third sector line 23, 24, so that the second setting valve 35 is assigned jointly to these two sector lines 23, 24. With the aid of a setting valve 34, 35 of this type, the quantity of the working gas which flows to the respective jet sectors 2, 3, 4 can be set.

The valve arrangement 29 comprises, moreover, a further setting valve 36 which is arranged in the first source line 17. This further setting valve 36 is also designated below as a third setting valve 36. The third setting valve 36 serves for setting the quantity of the working gas which flows through the first source line 17 and may be designed preferably as a pressure regulating valve.

In principle, the second source line 18, too, may be equipped with a setting valve of this type, with the aid of which the quantity of the working gas flowing through the second source line 18 can be set. However, the embodiment illustrated here is preferred, in which the valve arrangement 29 has a nonreturn valve arrangement 37 which is arranged in the second source line 18. The nonreturn valve arrangement 37 comprises, here, two nonreturn valves 38 which are arranged in series. The nonreturn valves 38 or the nonreturn valve arrangement 37 are or is designed in such a way as to shut off a gas flow which is oriented toward the second source 15. In contrast to this, the nonreturn valves 38 or the nonreturn valve arrangement 37 let or lets through a gas flow which comes from the second source 15.

According to the invention then, the valve arrangement 29 and the line system 13 are designed and coordinated with one another in such a way that at least three different operating states can be set for the SPAT 1. In particular, it is a question, here, of a first operating state, in which all the jet sectors 2 and 3 (FIG. 1) or 2 to 4 (FIG. 2) are supplied solely with the working gas of the first source 10. For this purpose, the third setting valve 36 opens, while at the same time the coupling valve 30 is opened. The cold resuperheated steam of the steam line 10 therefore flows, on the one hand, via the first sector line 22 to the first jet sector 2. Furthermore, with a coupling valve 30 open, the cold resuperheated steam flows through the connecting line 19 into the second source line 18, specifically as far as a nonreturn valve arrangement 37 which shuts off in this flow direction. Since the nonreturn valve arrangement 37 is expediently arranged between the second source 15, that is to say the bleeding point 15, and the second connection point 21, the resuperheated steam can pass via the second sector line 23 to the second jet sector 3. Moreover, in the embodiment according to FIG. 2, the resuperheated steam passes via the third sector line 24 to the third jet sector 4. This makes it possible for the blading of the SPAT 1 to be acted upon uniformly by the cold resuperheated steam of the first source 10.

Furthermore, a second operating state can be implemented, in which all the jet sectors 2 and 3 (FIG. 1) or 2 to 4 (FIG. 2) are supplied solely with the working gas of the second source 15. In order to achieve this, the coupling valve 30 is likewise opened, while at the same time the third setting valve 36 is shut off. Since the third setting valve 36 is located expediently between the first source 10, that is to say the steam line 10, and the first connection point 20, the bleed steam can also pass through the second source line 18 and, with a coupling valve 30 open, via the connecting line 19 into the first sector line 22 and therefore into the first jet sector 2. The bleed steam reaches the second jet sector 3 via the second sector line 23. In the variant according to FIG. 2, moreover, the bleed steam reaches the third jet sector 4 via the third sector line 24. Here, too, correspondingly, a uniform action upon the blading of the SPAT 1 by the bleed steam of the second source 15 can be achieved.

Moreover, according to the invention, a third operating state can be implemented, in which at least one jet sector is supplied solely with the working gas of the first source 10 and at least one jet sector is supplied solely with the working gas of the second source 15. This is achieved, here, in that the coupling valve 30 is shut off, while at the same time the third setting valve 36 assigned to the first source line 17 is opened. The cold resuperheated steam consequently passes from the first source 10 via the first sector line 22 to the first jet sector 2 again. In contrast to this, the bleed steam from the second source 15 arrives at the second jet sector 3 via the second sector line 23. Moreover, in the embodiment according to FIG. 2, the bleed steam can arrive at a third jet sector 4 via the third sector line 24. Here, correspondingly, the first jet sector 2 is supplied solely with cold resuperheated steam, while the second jet sector 3 and, if appropriate, the third jet sector 4 are supplied solely with bleed steam. Accordingly, even in the third operating state, a uniform action of working gas upon the blading of the SPAT 1 along the circumference can be achieved.

As already explained further above, uniform action in the circumferential direction upon the blading of the SPAT 1 by working gas is a precondition for achieving a particularly favorable efficiency of the SPAT 1.

Further, in the SPAT 1 according to the invention, by means of the selected valve arrangement 29, in conjunction with the line system 13 provided, further operating states can be implemented which may be appropriate for specific situations, but may result in reduced efficiencies. For example, the SPAT 1 may also be acted upon by cold resuperheated steam solely via the first jet sector 2. The coupling valve 30 and/or the second setting valve 35 are/is in this case shut off. The second jet sector 3 and, if appropriate, the third jet sector 4 may likewise be supplied with the cold resuperheated steam, while the first jet sector 2 is switched off, by the first setting valve 34 being shut off. Correspondingly, it is likewise possible to supply the first jet sector 2 with bleed steam, while the second jet sector 3 and, if appropriate, the third jet sector 4 are deactivated by the second setting valve 35 being shut off. Conversely, by the coupling valve 30 and/or the first setting valve 34 being shut off, the SPAT 1 may be supplied solely with bleed steam via the second jet sector 3 and, if appropriate, the third jet sector 4, while at the same time the first jet sector 2 is shut off.

What is claimed is:

1. A supply pump actuating turbine comprising:

at least two jet sectors configured to introduce a working gas into the turbine, each jet sector having an inlet to the turbine and the turbine being configured to drive a feed water supply pump of a steam generator;

a first source of working gas;

a second source of working gas;

a line system connecting the at least two jet sectors to the first and second sources; and a valve arrangement configured to adjust a supply of the working gas to the jet sectors from at least one of the first and second sources according to at least three operating states, including:

a first operating state, wherein the at least two jet sectors are supplied with the working gas from the first source;

a second operating state, wherein the at least two jet sectors are supplied with the working gas from the second source; and a third operating state, wherein at least one of the jet sectors is supplied with the working gas from the first source and at least one other of the jet sectors is supplied with the working gas of the second source.

2. The supply pump actuating turbine as recited in claim 1, wherein the line system includes a first source line connected to the first source, a second source line connected to the second source, a connecting line connecting the first source line to the second source line, and first and second sector lines each connecting one of the at least two jet sectors to a respective one of the first and second source lines, and wherein the valve arrangement includes a coupling valve disposed in the connecting line for opening and shutting off the connecting line.

3. The supply pump actuating turbine as recited in claim 2, wherein the valve arrangement includes a setting valve disposed in the first source line and configured to adjust a quantity of the working gas.

4. The supply pump actuating turbine as recited in claim 2, wherein the valve arrangement includes a setting valve disposed in the second source line and configured to adjust a quantity of the working gas.

5. The supply pump actuating turbine as recited in claim 2, wherein the valve arrangement includes a nonreturn valve arrangement disposed in the second source line and having a nonreturn valve configured to shut off a gas flow directed toward the second source.

6. The supply pump actuating turbine as recited in claim 2, wherein the valve arrangement includes at least one of a quick-action closing valve disposed in each of the first and second sector lines and configured to quickly shut off the respective sector line, and a setting valve disposed in at least one of the first and second sector lines and configured to adjust a quantity of the working gas.

7. The supply pump actuating turbine as recited in claim 2, wherein the at least two jet sectors includes a first, a second, and a third jet sector, wherein the supply pump actuating turbine further includes a third sector line connecting to the third jet sector, and wherein the second and third sector lines have a common source portion connected to a respective one of the first and second source lines and wherein the second and third sector lines each have a sector portion connecting a respective one of the second and third jet sectors to the source portion.

8. The supply pump actuating turbine as recited in claim 2, wherein the coupling valve is a motor valve.

9. The supply pump actuating turbine as recited in claim 2, wherein the coupling valve is configured to adjust a quantity of the working gas.

10. The supply pump actuating turbine as recited in claim 1, wherein the first source is a steam line leading expanded steam from a high-pressure turbine via a resuperheating stage to an inlet of a medium-pressure turbine.

11. The supply pump actuating turbine as recited in claim 1, wherein the working gas of the first source is cold resuperheated steam.

12. The supply pump-actuating turbine as recited in claim 1, wherein the second source includes a bleeding point of a medium-pressure turbine disposed between an inlet and an outlet of the medium-pressure turbine.

13. The supply pump actuating turbine as recited in claim 1, wherein the working gas of the second source is a bleed steam of a medium-pressure turbine, the bleed steam being extracted between an inlet and an outlet of the medium-pressure turbine.

14. The supply pump actuating turbine as recited in claim 1, wherein the supply pump actuating turbine is for a power plant.

* * * * *